US008713824B2

(12) United States Patent
Wang et al.

(10) Patent No.: US 8,713,824 B2
(45) Date of Patent: May 6, 2014

(54) OIL-STORAGE TYPE ELECTRIC IRON

(76) Inventors: Chansong Wang, Foshan (CN); Chiman Ao, Foshan (CN)

( * ) Notice: Subject to any disclaimer, the term of this patent is extended or adjusted under 35 U.S.C. 154(b) by 0 days.

(21) Appl. No.: 13/636,626

(22) PCT Filed: Aug. 4, 2010

(86) PCT No.: PCT/CN2010/075695

§ 371 (c)(1),
(2), (4) Date: Sep. 21, 2012

(87) PCT Pub. No.: WO2012/003650

PCT Pub. Date: Jan. 12, 2012

(65) Prior Publication Data

US 2013/0014410 A1 Jan. 17, 2013

(30) Foreign Application Priority Data

Jul. 6, 2010 (CN) ..... 2010 1 0222506

(51) Int. Cl.
*D06F 75/24* (2006.01)
*D06F 75/08* (2006.01)

(52) U.S. Cl.
USPC ..... 38/84

(58) Field of Classification Search
USPC ..... 38/74–93, 97; 99/348; 110/208, 238; 126/20, 361.1; 392/311, 339, 478; 165/104.23
See application file for complete search history.

(56) References Cited

U.S. PATENT DOCUMENTS

| | | | | | |
|---|---|---|---|---|---|
| 1,414,007 | A | * | 4/1922 | Berwick | 219/251 |
| 1,636,359 | A | * | 7/1927 | Gates | 38/84 |
| RE17,453 | E | * | 10/1929 | Klahn et al. | 337/318 |
| 4,837,952 | A | | 6/1989 | Hennuy et al. | |
| 5,592,765 | A | * | 1/1997 | Oomen et al. | 38/93 |
| 2008/0209773 | A1 | * | 9/2008 | Akhter | 38/75 |

FOREIGN PATENT DOCUMENTS

| | | |
|---|---|---|
| JP | 9117600 | 5/1997 |
| JP | 10277299 | 10/1998 |
| JP | 201850447 | 6/2011 |

OTHER PUBLICATIONS

International Search Report corresponding to co-pending International Patent Application Serial No. PCT/CN2010075695; dated Mar. 24, 2011, 4 pages.

* cited by examiner

*Primary Examiner* — Ismael Izaguirre
(74) *Attorney, Agent, or Firm* — Nixon Peabody LLP

(57) ABSTRACT

An oil-storing electric iron comprises: a flat ironing part including a stainless steel soleplate, a top casing plate, an electric heating tube and a heating conducting oil; and an adjustable temperature controller. The stainless steel soleplate and the top casing plate form an enclosed casing in which the electric heating tube and the heating conducting oil are provided. The thermal capacity of the electric iron soleplate can be effectively increased and the problem of instability and nonuniformity of the electrical iron soleplate temperature can be solved, so as to be uniform in temperature, easy to operate, safe in use and energy saving.

15 Claims, 5 Drawing Sheets

OIL-STORAGE TYPE ELECTRIC IRON

CROSS-REFERENCE TO RELATED APPLICATIONS

This application is a U.S. national stage of International Patent Application No. PCT/CN2010/075695, filed Aug. 4, 2010, which claims priority of Chinese Patent Application No. 201010222506.9, filed on Jul. 6, 2010, the contents of which are each incorporated herein by reference in its entirety.

FIELD OF THE INVENTION

The present invention relates to the field of electric irons of domestic appliance, and in particular relates to an oil-storage type electric iron.

DESCRIPTION OF THE PRIOR ART

In the prior art, the soleplate of an domestic electric iron is generally designed as a die-casted aluminum soleplate integrated with the heating tube, and an adjustable temperature controller mounted on the upper surface of soleplate is used to control the operations of heating tube, so as to control and regulate the temperature on the bottom surface of the soleplate of electric iron. Such electric iron has the following disadvantages: the specific-heat capacity of aluminum product is relatively lower, the thermal capacity of the soleplate of electric iron is relatively smaller, so that the first-stroke temperature at the starting time is high, the temperature fluctuation in the operation of electric iron is high, and the stability of operating temperature is poor, so that the use safety and ironing quality of electric iron are affected; in order to increase the thermal capacity of soleplate, it is generally necessary to increase the weight of the aluminum material for soleplate, which causes higher cost and energy consumption in production. Furthermore, the operation of electric iron is not sufficiently flexible due to increased weight. Furthermore, the surface abrasion resistance of the cast-aluminum soleplate is poor, so that it is necessary to spray a wearing coat on the bottom surface of soleplate. Such wearing coat has poor wearing property and may be easily scraped and worn. If the soleplate is wrapped with a stainless steel plate or an additional thin layer of wear resistant soleplate, such problems as lower thermal efficiency and higher wear will occur. Furthermore, said electric iron also has such problems as uneven temperature distribution on the bottom surface of soleplate, higher temperature at the position corresponding to the heating tube and lower temperature at other positions. However, since domestic electric irons generally adopt dynamic ironing mode, so that the uneven surface temperature of soleplate causes less influence. Therefore, in the field of domestic iron irons, an electrothermal tube is habitually used to directly heat the metal plate. Furthermore, all the traditional electric irons are designed as electric irons with core (with power line). In the practical use, due to the dragging operation of power line and the limit in the distance from power supply, more convenient and comprehensive use of the traditional electric irons are affected.

SUMMARY OF THE INVENTION

With the view of said problems, it is the technical object of the present invention to provide an oil-storage type electric iron, which is featured by high stability and evenness of working temperature, convenient, flexible and safe operation and long service life and can reduce material costs and energy consumption in production and thus save resources.

More specifically, the present invention provides an oil-storage type electric iron, comprising a flat ironing part and an adjustable temperature controller 6, wherein the flat ironing part comprises a stainless steel soleplate 1, an upper casing plate 2, an electrothermal tube 3 and a heat conducting oil 4; the stainless steel soleplate 1 and the upper casing plate 2 form a closed shell; and the closed shell is internally provided with the electrothermal tube 3 and the heat conducting oil 4.

In addition, the closed shell is also internally provided with an electrothermal tube bracket 5 and a temperature controller mounting seat 7; the adjustable temperature controller 6 is provided on the temperature controller mounting seat 7, and the electrothermal tube bracket 5 is permanently connected with the electrothermal tube 3 and the temperature controller mounting seat 7 respectively.

Preferably, the adjustable temperature controller 6 is an adjustable temperature controller made of thermal bimetal strip and also comprises a temperature overheat protector.

Preferably, the temperature overheat protector comprises a pair of temperature control switch contacts 6.5 provided on the adjustable temperature controller 6; an arched spring piece 6.1 is connected in series with the temperature control switch contacts 6.5, an eutectic tin alloy welding spot 6.2 is used to weld the free end of the arched spring piece 6.1 with the free end of a first wiring terminal 6.3 for the purpose of conducting, the fixed end of the first wiring terminal 6.3 is separated from the fixed end of the arched spring piece 6.1 by means of a mica washer 6.6; the first wiring terminal 6.3 and a second wiring terminal 6.4 are respectively connected with the electrothermal tube 3 and the power input end.

Preferably, the oil-storage type electric iron also comprises a pair of contact pins 11, the contact pins 11 are provided under a terminal box 30 at the rear end of the oil-storage type electric iron, the ends of the contact pins 11 are respectively connected with the electrothermal tube 3 and the adjustable temperature controller 6 through a pair of wiring terminals 12 inside the terminal box 30, and another end of the contact pins 11 is an extending end which extends from the terminal box 30 and is connected with a power supply device.

Preferably, The power supply device is a preheating power socket, which comprises a pair of contact spring pieces 13, a pair of power wiring terminals 21 and a power line 22; the free end of the contact spring piece 13 is contiguously connected with the extending end of the contact pin 11, the surface of the contact spring piece 13 and the surface of the extending end of the contact pin 11 are respectively provided with a silver coating or a compound silver coating.

The oil-storage type electric iron and the preheating power socket also comprise an electrical connection safety device, the electrical connection safety device comprises a pushing boss 14, a movable pressing block 15, a fixed plate 16 and a movable spring piece 17; the pushing boss 14 is provided on the terminal box 30 at the rear end of the electric iron, the movable pressing block 15 is provided on the preheating power socket; a resetting torsion spring 18 is provided on the pivot of the movable pressing block 15; one end of the fixed plate 16 is connected with the fixed end of a contact spring piece 13, and a first electrical contact 19 is provided on the another end of the fixed plate 16; one end of the movable spring piece 17 is connected with the power wiring terminal 21, and a second electrical contact 20 is provided on the another end of the movable spring piece 17; when the oil-storage type electric iron is placed in the preheating power socket, the extending end of the contact pin 11 is connected with the free end of the contact spring piece 13, the pushing boss 14 pushes the movable pressing block 15 to move downwards and press down the movable spring piece 17, so that the second electrical contact 20 of the movable spring piece 17 contacts with the first electrical contact 19 of fixed plate 16; The preheating power socket also comprises a bracket seat 23 and a thermal insulation cushion 24; the inclination angle of the table of the bracket seat 23 is 15°-45°, and the thermal insulation cushion 24 is made of soft silica gel.

A coating layer is provided in the whole/partial periphery on the side of the closed shell, and the coating layer is composed of one, two or three kinds of reversible thermopaints 25 which can change colors at specific temperature.

The oil-storage type electric iron also comprises a steam-generating device, and the steam-generating device comprises a second closed shell 26, a steam conduit 27, a second electrothermal tube 28 and a temperature-limiting type temperature controller 29; water and steam are provided in the second closed shell 26.

The second closed shell 26 is provided above the flat ironing part and is permanently connected with the built-in mounting seat 10 in the closed shell; a water filling nozzle sealed tube 31 and a cock 32 are provided on the second closed shell 26, the second electrothermal tube 28 is provided inside the second closed shell 26, a steam inlet 27.1 is provided on the upper end of the steam conduit 27, a lower port 27.2 of the steam conduit 27 extends out of the second closed shell 26; a steam-spray chamber 27.3 is provided between the upper casing plate 2 and the stainless steel soleplate 1, a steam-spray hole 1.1 is provided on the stainless steel soleplate 1, and the position of the steam-spray hole 1.1 corresponds to the position of the steam-spray chamber 27.3.

The beneficial effects of the present invention as follows:

The present invention breaks through the traditional use mode of electric iron, and puts forward a solution to effectively solve such problems as low thermal capacity, poor temperature stability, temperature uniformity, durability and safety of the soleplate of electric iron. In addition, the cordless electric iron is adopted to provide more convenient and safe operations. The present invention can also be used in combination with the steam-generating device to further improve the functions of electric iron.

The technical solution of the present invention is described in detail in combination with the attached figures and the specific embodiments.

BRIEF DESCRIPTION OF THE DRAWINGS

FIG. 5.2 is the schematic diagram of the upper section and local section of the preheating power socket as disclosed in the embodiment 2 of the present invention;

| Symbols in the attached drawings: | | |
|---|---|---|
| 1. Stainless steel soleplate | 1.1. Steam-spray hole | 2. Upper casing plate |
| 3. Electrothermal tube | 4. Heat conducting oil | |
| 5. Electrothermal tube bracket | 6. Adjustable temperature controller | |
| 6.1. Arched spring piece | 6.2. Eutectic tin alloy welding spot | |
| 6.3. First wiring terminal | 6.4. Second wiring terminal | |
| 6.5. Temperature control switch contact | 6.6. Mica washer | |
| 6.7. Bimetal strip | 6.8. Temperature regulating shaft | |
| 6.9. Spring assembly | 7. Temperature controller mounting seat | |
| 8. Reinforcing rib | 9. Shell | 10. Mounting seat |
| 11. Contact pin | 12. Wiring terminal | 13. Contact spring piece |
| 14. Pushing boss | 15. Movable pressing block | 16. Fixed plate |
| 17. Movable spring piece | 18. Resetting torsion spring | |
| 19. First electrical contact | 20. Second electrical contact | |
| 21. Power wiring terminal | 22. Power line | 23. Bracket seat |
| 24. Thermal insulation cushion | 25. Reversible thermopaint | |
| 26. Second closed shell | 27. Steam conduit | 27.1. Steam inlet |
| 27.2. Lower port | 27.3. Steam-spray chamber | |
| 28. Second electrothermal tube | 29. Temperature-limiting temperature controller | |
| 30. Terminal box | 31. Water filling nozzle sealed tube | |
| 32. Cock | 33. Steam indicating switch | 34. Heating indication lamp |

DETAILED DESCRIPTION OF THE PREFERRED EMBODIMENTS

Embodiment 1

Figure 1:
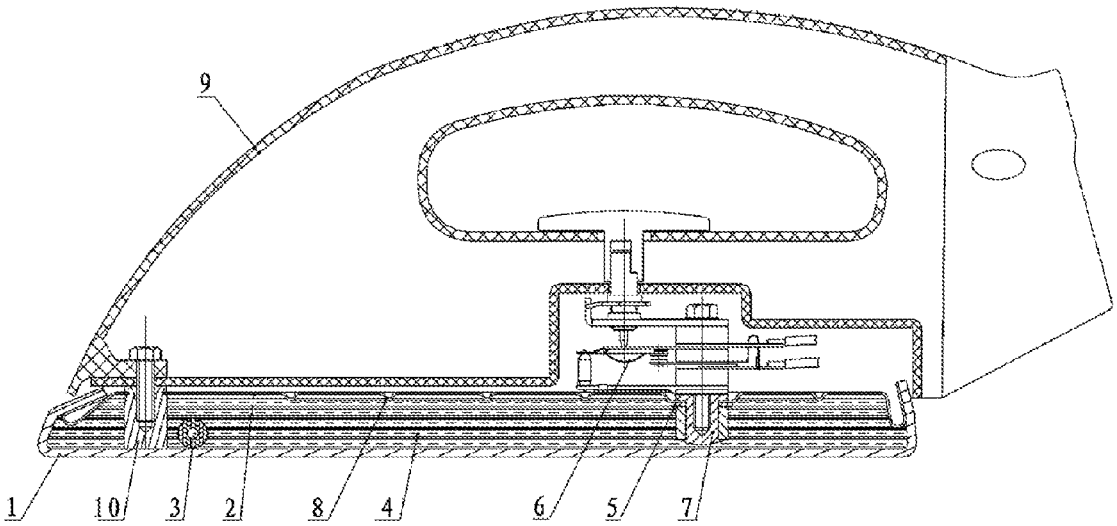
FIG. 1 is the structural diagram of the embodiment 1 of the present invention.

FIG. 1 is the structural diagram of the embodiment 1 of the present invention; As shown in FIG. 1, the flat ironing part of the electric iron comprises a stainless steel soleplate 1, an upper casing plate 2, an electrothermal tube 3, a heat conducting oil 4, an electrothermal tube bracket 5, a temperature controller mounting seat 7 and a mounting seat 10. The soleplate 1 and the upper casing plate 2 form a closed shell. The closed shell is internally provided with the electrothermal tube 3 and filled with high-temperature resistant heat conducting oil 4. However, the closed shell is not completely filled with the heat conducting oil 4, so as to reserve the space for expansion of heat conducting oil at high temperature.

Generally, the specific-heat capacity of heat conducting oil is 2-3 KJ/Kg° C., while the specific-heat capacity of aluminum is merely 0.88 KJ/Kg° C. With the same weight, the thermal capacity of heat conducting oil is 2.5-3.5 times as much as that of aluminum. Since the media of heat conducting oil is heated by means of heating tube and the thermal capacity is transferred to the whole surface of the soleplate, as compared with the case where the electrothermal tube is used to directly heat the soleplate, the temperature uniformity of the soleplate of electric iron is improved. Therefore, if the oil-storage type electric iron is adopted, it is feasible to increase the thermal capacity of the soleplate of electric iron by several times against the made metallic soleplate, so that such problems as poor temperature stability and temperature uniformity and high temperature fluctuation on the ironing bottom surface of electric iron can be solved. With smaller working temperature fluctuation, lower action frequency of temperature controller and lower thermal shock at the time of starting up, the service life of electric iron can be effectively extended.

The stainless steel soleplate 1 can be made of stainless steel plate in thickness of 1.2-2.5 mm, which is punched into a disk-shaped soleplate of iron. The upper casing plate 2 can be made of stainless steel plate in thickness of 0.5-1 mm, which is punched into a disk-shape matching with the periphery of the stainless steel soleplate 1. Since the stainless steel plate has satisfactory corrosion resistance and wearability, the polished soleplate is durable in use and is uneasily damaged in collision. As compared with the cast aluminum plate sprayed with wear-resistant coating or wrapped with stainless steel surface, the polished soleplate can effectively improve the durability of electric iron and reduce the material costs and energy consumption in production. Since heat conducting oil is used to transfer heat, the surface temperature of the soleplate is even and stable without local high temperature, so that such problems as local colour change on the surface of the stainless steel soleplate and plastering of fabric will not occur, which often occur on the surface of the cast aluminum soleplate.

Several reinforcing ribs 8, which emboss inwards, are provided on the upper casing plate 2, so as to strengthen the rigidity of the upper casing plate 2 on the one hand and to play the function of wave elimination on the other hand, namely to eliminate the surge that may be generated by the heat conducting oil in the movement of electric iron.

Figure 2:
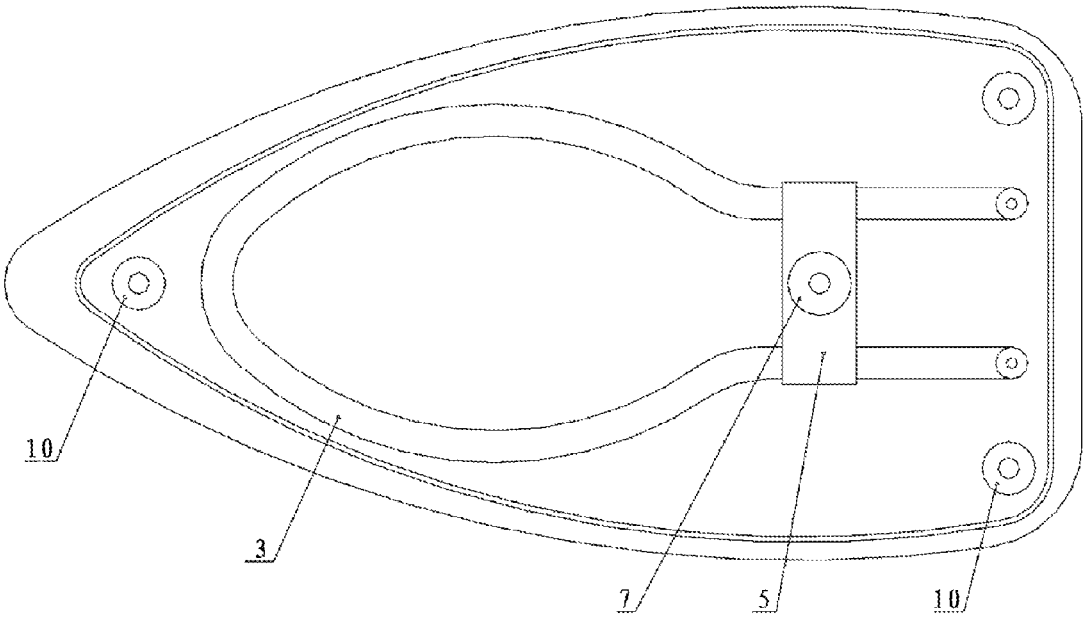
FIG. 2 is the schematic diagram of the position of an electrothermal tube in the soleplate of the electric iron as disclosed in the embodiment 1 of the present invention.

FIG. 2 is the schematic diagram of the position of an electrothermal tube 3 in the soleplate of the electric iron. As shown in FIG. 1 in combination with FIG. 2, the electrothermal tube 3 is horizontally placed and immersed in the heat conducting oil 4 in the closed shell formed by the stainless steel soleplate 1 and the upper casing plate 2; the adjustable temperature controller 6 is provided on the temperature controller mounting seat 7; the electrothermal tube bracket 5 is permanently connected with the electrothermal tube 3 and the temperature controller mounting seat 7 respectively; The electrothermal tube 3 is approximate to U-shaped tube; both ends of the electrothermal tube bracket 5 firmly hold the electrothermal tube 3; the middle section of the electrothermal tube bracket 5 sockets the temperature controller mounting seat 7, and the temperature controller mounting seat 7 makes the electrothermal tube bracket 5 firmly attached the upper casing plate 2. Since the electrothermal tube bracket 5 is connected with the electrothermal tube 3 and is firmly attached onto the upper end surface of the temperature controller mounting seat 7, the reaction sensitivity of the adjustable temperature controller 6 to the temperature of the electrothermal tube 3 can be improved, and temperature control can be performed in time, so that the temperature of the heat conducting oil 4 in the closed shell becomes even stable.

Figure 3:
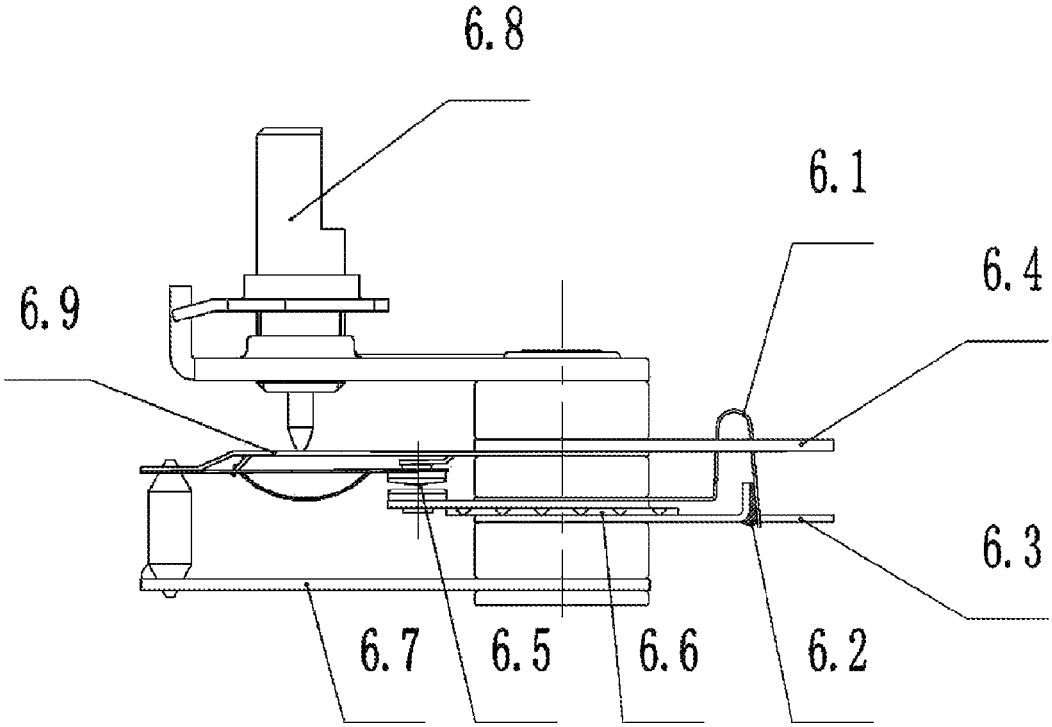
FIG. 3 is the structural diagram of the adjustable temperature controller with the temperature overheat protector as shown in FIG. 1.

FIG. 3 is the schematic diagram of the adjustable temperature controller 6. The adjustable temperature controller 6 is an adjustable temperature controller made of thermal bimetal strip, which comprises a bimetal strip 6.7 and a temperature regulating shaft 6.8; a temperature overheat protector with temperature overheating protection function is also provided on the adjustable temperature controller 6, and the temperature overheat protector is used to cut off the circuit of electrothermal tube 3 in case of abnormal temperature control of the adjustable temperature controller 6, which plays the function of safety protection. As shown in FIG. 3 in combination with FIG. 7, said temperature overheat protector is an arched spring piece 6.1, which is provided on the adjustable temperature controller 6 and is connected in series with a pair of temperature control switch contacts 6.5.

An eutectic tin alloy welding spot 6.2 is used to weld the free end of the arched spring piece 6.1 with the free end of a first wiring terminal 6.3 for the purpose of conducting, the fixed end of the first wiring terminal 6.3 is separated from the fixed end of the arched spring piece 6.1 by means of a mica washer 6.6; the first wiring terminal 6.3 and a second wiring terminal 6.4 are respectively connected with the electrothermal tube 3 and the power input end; through a spring assembly 6.9 in the adjustable temperature controller 6, a pair of temperature control switch contacts 6.5, the arched spring piece 6.1 and the first wiring terminal 6.3, the second wiring terminal 6.4 forms electrical connection with the electrothermal tube 3.

The preset dangerous temperature for the stainless steel soleplate 1 of the electric iron is 360° C. When the temperature of the soleplate rises to the melting point temperature 240° C. of the eutectic tin alloy welding spot, the eutectic tin alloy welding spot 6.2 melts, so that the arched spring piece 6.1 springs open and thus switches off the circuit connected from the power input end to the electrothermal tube 3, playing the function of safety protection.

Embodiment 2

Figure 4:
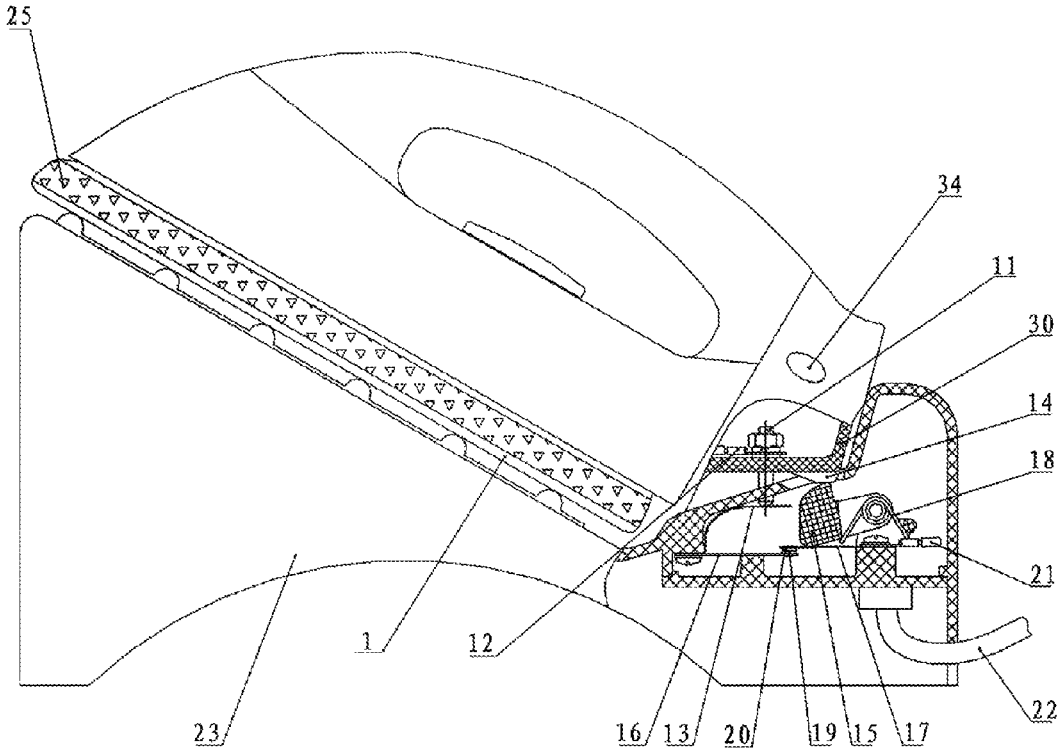
FIG. 4 is the structural diagram of the cordless electric iron with the contact pins and the preheating power socket as disclosed in the embodiment 2 of the present invention.
Figure 7:
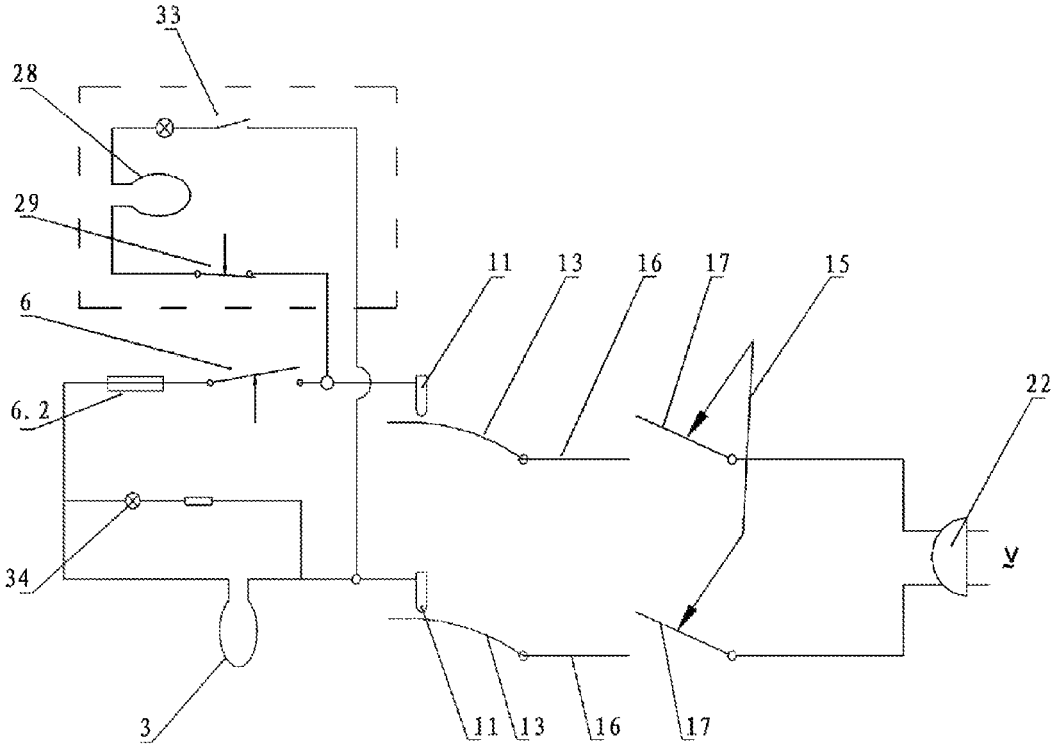
FIG. 7 is the schematic diagram of the circuit structure as disclosed in the embodiment 2 of the present invention.

FIG. 4 is the structural diagram of the embodiment 2 where the cordless oil-storage type electric iron with contact pin is placed on a preheating power socket; FIG. 7 is the schematic diagram of the circuit structure as disclosed in the embodiment 2.

In general, an electric iron is provided with a power line and a plug. For the purpose of ironing operation, it is necessary to insert the power line on the power supply socket, so that the electric iron can generate heat and work. However, the dragging and shackling of the power line cause inconveniences in use and operation of the electric iron. Sometimes, the clothing may be contaminated by the pollutions on the power line. If a cordless electric iron is used, the temperature of electric iron drops very quickly due to small thermal capacity of the traditional metallic soleplate, so that it is necessary to preheat the electric iron frequently, which causes inconvenience. If an oil-storage type electric iron is used, since the soleplate of oil storage type iron has big thermal capacity, there will be longer effective operation time after a preheating. Therefore, it is especially advisable to adopt a cordless electric iron. When the power supply is relatively far from the clothing to be ironed, there is no need to drag the power line, the operation process becomes more flexible and clean, and the range of uses and functions of the electric iron can be greatly extended. Furthermore, being able to operate in uncharged state, the electric iron is safer and energy-saving.

As shown in FIG. 4 in combination with FIG. 7, a pair of contact pins 11 in the cordless oil-storage type electric iron with contact pin are provided on a terminal box 30 at the rear end of the electric iron, one end of contact pins 11 in the shell is respectively connected with such elements as the electrothermal tube 3 and the adjustable temperature controller 6 through the wiring terminal 12, namely one end of one of a pair of contact pins 11 is connected with the electrothermal tube 3 through the wiring terminal 12, one end of another contact pin 11 is connected with the adjustable temperature controller 6 through the wiring terminal 12, and another end of the contact pin is an extending end, which extends out of the terminal box 30 of the oil-storage type electric iron and is connected with the power supply device. A contact spring piece 13 is composed of a pair of thin bronze strips corresponding to the contact pins 11, and its free end is connected with the extending end of the contact pin 11 through coordinated contact. To guarantee satisfactory electrical contact, it is feasible provide silvered or compound silvered contact surface on the end surface of the extending end of the contact pin 11 and on the surface of the contact spring piece 13.

In order to prevent the safety problem from being caused by an electric iron, which contacts with an exposed contact spring piece 13 before it is placed on the preheating power socket, and an electrical connection safety device is adopted on the electrical connection position of the electric iron and the preheating power socket in this embodiment. As shown in FIG. 4, the electrical connection safety device comprises a pushing boss 14, a movable pressing block 15, a fixed plate 16 and a movable spring piece 17. The pushing boss 14 is provided on the terminal box 30 under the back of electric iron, which is nearby a pair of contact pins 11, the movable pressing block 15 is provided on the preheating power socket, a resetting torsion spring 18 is provided on the pivot of the movable pressing block 15, the ends of a pair of fixed plates 16 are respectively connected with the fixed ends of a pair of contact spring pieces 13, a first electrical contact 19 is provided on the another end of a pair of fixed plates 16. The movable spring pieces 17 are a pair of thin bronze strips, the fixed ends of the movable spring pieces 17 are respectively connected with the power wiring terminals 21 at two poles of the power line 22(zero line/live wire), its another end is a free end, on which a second electrical contact 20 is provided. The initial position of the free end of the movable spring piece 17 is set above the free end of the fixed plate 16, so that the second electrical contact 20 is separated from the first electrical contact 19.

As shown in FIG. 4 in combination with FIG. 7, when the electric iron is placed on the preheating power socket, the extending end of the contact pin 11 firstly contacts with the free end of the contact spring piece 13. At this moment, the movable pressing block 15 has not been pressed downwards in place, and the first electrical contact 19 does not contact with the second electrical contact 20, namely, before the contact pin 11 contacts with contact spring piece 13 and at the moment when they contact, the contact spring piece 13 is uncharged. Therefore, it is feasible to prevent electric shock when a operator touches the exposed contact spring piece 13, prevent arc discharge at the moment of contact and to avoid the arc erosion from generating adverse impact on the service life and electrical contact properties of contacted elements as well as the electromagnet interference caused by the electric arc to power network. After the contact pin 11 has contacted with the contact spring piece 13, the pushing boss 14 continues to push the movable pressing block 15 to move downwards and push downwards the movable spring piece 17, until the second electrical contact 20 contacts with the first electrical contact 19, so that the heating tube 3 of the cordless electric iron is powered on.

Because the movable spring piece 17 has lost the pushing force of the movable pressing block 15 when the electric iron leaves from the preheating power socket, the movable spring piece 17 moves upwards under the effect of the elastic force generated by the resetting torsion spring 18 and the movable spring piece 17, so that the second electrical contact 20 is disengaged from the first electrical contact 19, the power supply is disconnected and the contact spring piece 13 is powered off. At this moment, under the effect of elastic force, the contact spring piece 13 pushes the contact pin 11 to move up simultaneously, so that the contact pin 11 has been under power off condition although the contact pin 11 has not been disengaged from the contact spring piece 13. Therefore, when the contact pin 11 is disengaged from the contact spring piece 13, arc phenomenon will unlikely occur, the resetting torsion spring 18 resets the movable pressing block 15 and the movable spring piece 17 returns to its initial position.

In order to guarantee that the contact spring piece 13 is uncharged whenever the contact pin 11 contacts with or separates from the contact spring piece 13, it is necessary to make the extension height of the contact pin 11 and the contact stroke in coordination with the contact spring piece 13 exceed the height of the pushing boss 14 at the tail of electric iron as well as the stroke in coordination with the movable pushing 15, so that when the movable pressing block 15 in coordination with the pressing boss 14 is pressing on the first electrical contact 19 and the second electrical contact 20, the time point when electrical contact 19 is connected with the second electrical contact 20, is posterior to the time point when the contact pin 11 is connected with the contact spring piece 13, and the time point when electrical contact 19 is disconnected with the second electrical contact 20, is ahead of the time point when the contact pin 11 is disconnected with the contact spring piece 13. That is to say, when a cordless electric iron is placed, the contact pin 11 firstly contacts with the contact spring piece 13, and subsequently the movable pressing block 15 presses down the movable spring piece 17, so that the first electrical contact 19 contacts with the second electrical contact 20, and the power supply is turned on. When the cordless electric iron is removed, the movable pressing block 15 firstly loosens the movable spring piece 17, so that the first electrical contact 19 is separated from the second electrical contact 20, the power supply is turned off, and in turn the contact pin 11 is separated from the contact spring piece 13.

Figure 5:
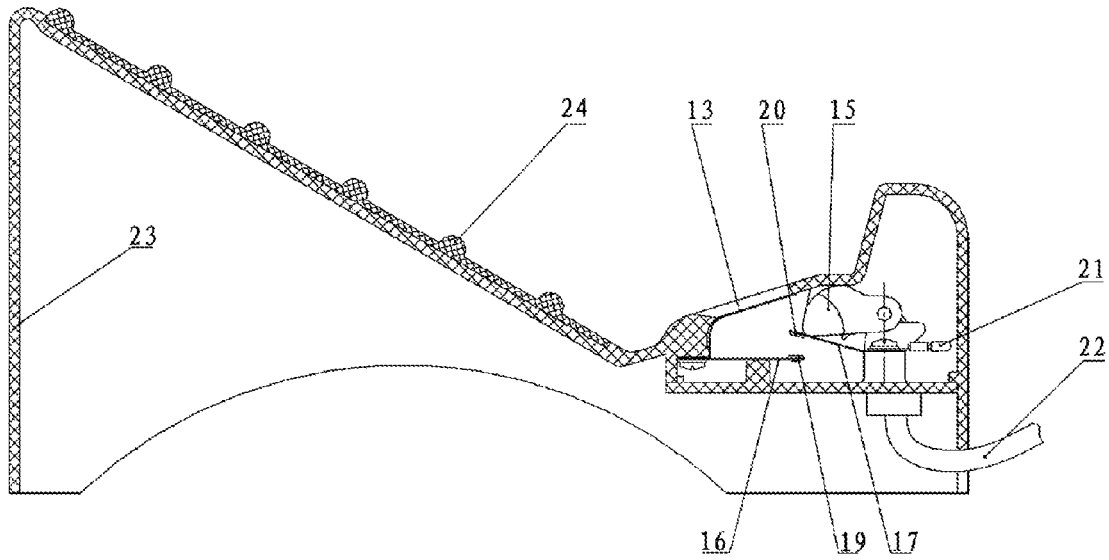
FIG. 5.1 is the schematic diagram of the side section of the preheating power socket as disclosed in the embodiment 2 of the present invention.
Figure 5:
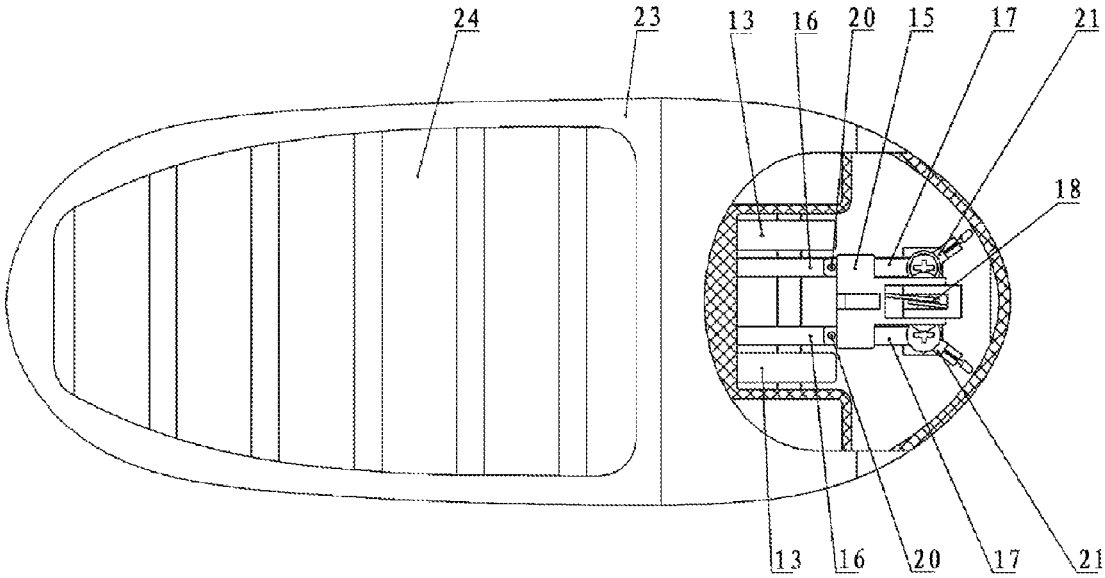

FIG. 5.1 is the schematic diagram of the side section of the preheating power socket as disclosed in the embodiment 2, FIG. 5.2 is the schematic diagram of the upper section and local section of the preheating power socket as disclosed in the embodiment 2. As shown in FIG. 5.1, the preheating power socket also comprises a bracket seat 13 and a thermal insulation cushion 24, which is used for skid-proof and heat-insulated when the electric iron is placed, the thermal insulation cushion 24 can be made of soft silica gel. The inclination angle of the table of the bracket seat 23 is 15~45°, so that when an electric iron is placed on the bracket seat 23, the contact pins 11 can reliably contact with the contact spring piece 13.

The said electrical-connection safety device can be used to further improve the safety and service life of electric iron and to generate the effect of ensuring the safety of a power network.

FIG. 4 is the structural diagram of the reversible thermopaint sprayed in the periphery of the soleplate of electric iron. As shown in FIG. 4, a reversible thermopaint 25 is sprayed on the exposed side around the stainless steel soleplate 1 of the electric iron; the reversible thermopaint 25 can be composed of one, two or three kinds of coatings which spray the whole cycle, part or pattern shape. For example, the reversible thermopaint 25 can be sprayed in the periphery of the soleplate 1 and is in black at temperature. In the process of preheating the soleplate, the color of the coating turns from black into red. When the temperature of the soleplate has reached the preset value, the temperature controller acts, and the heating indication lamp 34 of heating tube is off; in the operation and use of a cordless electric iron, the temperature of the soleplate gradually drops. When the temperature of the soleplate has dropped to the temperature at which the color of the coating changes, the color of the coating turns from red into black, prompting that it is necessary to replace the preheating power socket for heating. For example, it is feasible to spray reversible thermopaints in different colors in the periphery of the soleplate, so as to reflect diversified temperature specifications and form diversified temperature displaying functions. For example, three kinds of reversible thermopaints in three different colors can be provided, with their color-changing temperatures being 80° C., 130° C. and 180° C. respectively. If the coating with color-changing temperature of 80° C. changes color while the coating with color-changing of 130° C. does not change color, it is indicated that the temperature of the soleplate is within the range of 80-130° C.; If the coating with color-changing temperature of 130° C. changes color while the coating with color-changing of 180° C. does not change color, it is indicated that the temperature of the soleplate is within the range of 130-180° C.; If the coating with color-changing temperature of 180° C. changes color, it is indicated that the temperature of the soleplate is above 180° C.; if all the paints have not changed color, it is indicated that the temperature of the soleplate is below 80° C. It is also feasible to spray the reversible thermopaint into pictorial trademark or text or other kinds of patterns. In a word, it is feasible to adopt reversible color-changing thermopaints to display temperatures, generating such effects as a simple and visual, facilitate operation and decoration.

Embodiment 3

Figure 6:
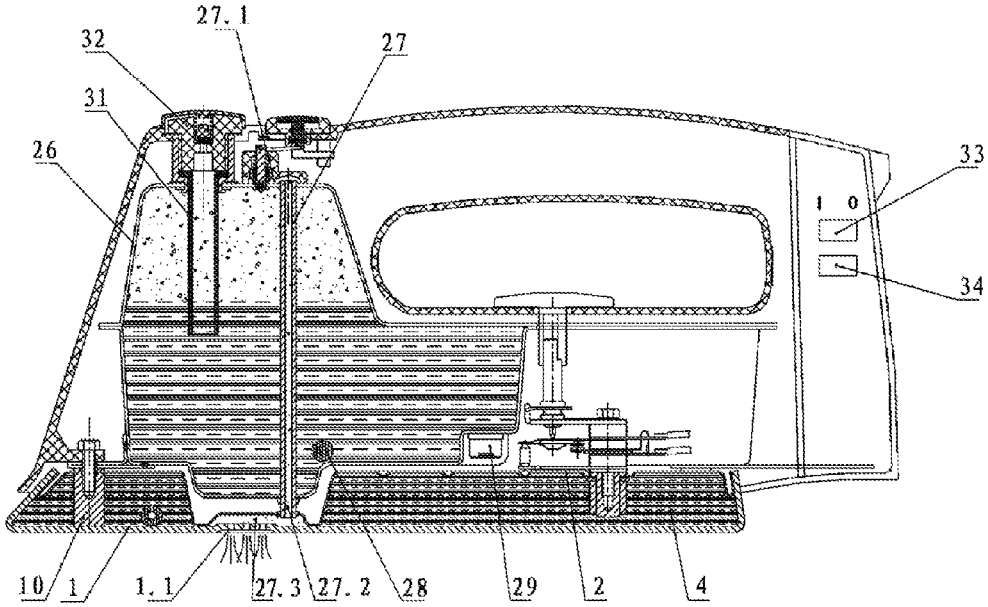
FIG. 6 is the structural diagram of the steam oil-storage type electric iron as disclosed in the embodiment 3 of the present invention.

FIG. 6 is the structural diagram of the embodiment 3 of the present invention. As shown in FIG. 6, the electric iron also comprises a steam-generating device, the steam generating device comprises a second closed shell 26 for accommodating water and steam, a steam conduit 27, a second electrothermal tube 28 and a temperature-limiting temperature controller 29; the second closed shell 26 is permanently connected with a mounting seat 10 inside the flat ironing part; a water filling nozzle sealed tube 31 and a cock 32 are provided on the second closed shell 26, the second electrothermal tube 28 is provided inside the second closed shell 26, a steam inlet 27.1 is provided on the upper end of the steam conduit 27, the lower port 27.2 of the steam conduit extends out of the second closed shell 26; a steam-spray chamber 27.3 is provided between the upper casing plate 2 and the soleplate 1 of the flat ironing part, a steam-spray hole 1.1 is provided on the stainless steel soleplate 1, and the position of the steam-spray hole 1.1 corresponds to the position of the steam-spray chamber.

When the electric iron is required to use steam for working, the steam indicating switch 33 may be turned on, so that the second electrothermal tube 28 heats the water in the second closed shell 26 to boil and generate steam; after the steam has entered the steam inlet 27.1 above the steam conduit 27, the steam enters the steam-spray chamber 27.3 from the lower port 27.2 and then is sprayed out from the steam-spray hole 1.1 above the soleplate of the iron.

An oil-storage type electric iron can be designed as a cordless or a core dry ironing type electric iron without steam generation part, also can be designed as a cordless or a core team type electric iron with steam generation part. In general cases, it is advisable to adopt cordless type for dry ironing electric iron and adopt electric iron with core for steam type electric iron.

In conclusion, the oil-storage type electric iron provided by the present invention has such advantages as temperature uniformity, convenient operation, energy saving, safety use and high economic value and use value and breaks through the mode of the traditional electric iron.

What is claimed is:

1. An oil-storage type electric iron, comprising a flat ironing part and an adjustable temperature controller, characterized in the following:

the flat ironing part comprises a stainless steel soleplate, an upper casing plate, an electrothermal tube and a heat conducting oil; the stainless steel soleplate and the upper casing plate form a closed shell; and the closed shell is internally provided with the electrothermal tube and the heat conducting oil, and the closed shell is internally provided with an electrothermal tube bracket and a temperature controller mounting seat, the adjustable temperature controller is provided on the temperature controller mounting seat, and the electrothermal tube bracket is permanently connected with the electrothermal tube and the temperature controller mounting seat respectively.

2. The oil-storage type electric iron of claim 1, characterized in the following:

the adjustable temperature controller is an adjustable temperature controller made of thermal bimetal strip and also comprises a temperature overheat protector.

3. The oil-storage type electric iron of claim 2, characterized in the following:

the temperature overheat protector comprises a pair of temperature control switch contacts provided on the adjustable temperature controller; an arched spring piece is connected in series with the temperature control switch contacts; an eutectic tin alloy welding spot is used to weld the free end of the arched spring piece with the free end of a first wiring terminal for the purpose of conducting, the fixed end of the first wiring terminal is separated from the fixed end of the arched spring piece by means of a mica washer; the first wiring terminal and a second wiring terminal are respectively connected with the electrothermal tube and the power input end.

4. The oil-storage type electric iron of claim 1, characterized in the following:

the oil-storage type electric iron also comprises a pair of contact pins, the contact pins are provided under a terminal box at the rear end of the oil-storage type electric iron, the ends of the contact pins are respectively connected with the electrothermal tube and the adjustable temperature controller through a pair of wiring terminals inside the terminal box, and another end of the contact pins is an extending end which extends from the terminal box and is connected with a power supply device.

5. The oil-storage type electric iron of claim 4, characterized in the following:

the power supply device is a preheating power socket, which comprises a pair of contact spring pieces, a pair of power wiring terminals and a power line; the free end of the contact spring pieces is contiguously connected with the extending end of the contact pins, the surface of the contact spring piece and the surface of the extending end of the contact pins are respectively provided with a silver coating or a compound silver coating.

6. The oil-storage type electric iron of claim 5, characterized in the following:

the oil-storage type electric iron and the preheating power socket also comprise an electrical connection safety device, the electrical connection safety device comprises a pushing boss, a movable pressing block, a fixed plate and a movable spring piece; the pushing boss is provided on the terminal box at the rear end of the electric iron, the movable pressing block is provided on the preheating power socket; a resetting torsion spring is provided on the pivot of the movable pressing block; one end of the fixed plate is connected with the fixed end of a contact spring piece, and a first electrical contact is provided on the another end of the fixed plate; one end of the movable spring piece is connected with the power wiring terminal, and a second electrical contact is provided on the another end of the movable spring piece; when the oil-storage type electric iron is placed on the preheating power socket, the extending end of the contact pin is connected with the free end of the contact spring piece, the pushing boss pushes the movable pressing block to move downwards and press down the movable spring piece, so that the second electrical contact of the movable spring piece contacts with the first electrical contact of fixed plate.

7. The oil-storage type electric iron of claim 5, characterized in the following:

the preheating power socket also comprises a bracket seat and a thermal insulation cushion; the inclination angle of the table of the bracket seat is 15-45°, and the thermal insulation cushion is made of soft silica gel.

8. The oil-storage type electric iron of claim 1, characterized in the following:

a coating layer is provided in the whole/partial periphery on the side of the closed shell, and the coating layer is composed of one, two or three kinds of reversible thermopaints which can change colors at specific temperature.

9. The oil-storage type electric iron of claim 1, characterized in the following:

the oil-storage type electric iron also comprises a steam-generating device, and the steam-generating device comprises a second closed shell, a steam conduit, a second electrothermal tube and a temperature-limiting type temperature controller; water and steam are provided in the second closed shell.

10. The oil-storage type electric iron of claim 9, characterized in the following:

the second closed shell is provided above the flat ironing part and is permanently connected with a mounting seat in the closed shell; a water filling nozzle sealed tube and a cock are provided on the second closed shell, the second electrothermal tube is provided inside the second closed shell, a steam inlet is provided on the upper end of the steam conduit, a lower port of the steam conduit extends out of the second closed shell; a steam-spray chamber is provided between the upper casing plate and the stainless steel soleplate, a steam-spray hole is provided on the stainless steel soleplate, and the position of the steam-spray hole corresponds to the position of the steam-spray chamber.

11. The oil-storage type electric iron of claim 1, characterized in the following:

the adjustable temperature controller is an adjustable temperature controller made of thermal bimetal strip and also comprises a temperature overheat protector.

12. The oil-storage type electric iron of claim 11, characterized in the following:

the temperature overheat protector comprises a pair of temperature control switch contacts provided on the adjustable temperature controller;

an arched spring piece is connected in series with the temperature control switch contacts;

an eutectic tin alloy welding spot is used to weld the free end of the arched spring piece with the free end of a first wiring terminal for the purpose of conducting, the fixed end of the first wiring terminal is separated from the fixed end of the arched spring piece by means of a mica washer; and the first wiring terminal and a second wiring terminal are respectively connected with the electrothermal tube and the power input end.

13. The oil-storage type electric iron of claim 6, characterized in the following:

the preheating power socket also comprises a bracket seat and a thermal insulation cushion;

the inclination angle of the table of the bracket seat is 15-45°, and the thermal insulation cushion is made of soft silica gel.

14. The oil-storage type electric iron of claim 4, characterized in the following:

a coating layer is provided in the whole/partial periphery on the side of the closed shell, and the coating layer is composed of one, two or three kinds of reversible thermopaints which can change colors at specific temperature.

15. The oil-storage type electric iron of claim 4, characterized in the following:

the oil-storage type electric iron also comprises a steam-generating device, and the steam-generating device comprises a second closed shell, a steam conduit, a second electrothermal tube and a temperature-limiting type temperature controller; water and steam are provided in the second closed shell.

* * * * *